US008292604B2

(12) United States Patent
Gault et al.

(10) Patent No.: US 8,292,604 B2
(45) Date of Patent: Oct. 23, 2012

(54) PERISTALTIC PUMP

(75) Inventors: Joseph Benjamin Gault, Portland, OR (US); Michael Cameron Gordon, West Linn, OR (US); Barry Daniel Reeves, Lake Oswego, OR (US)

(73) Assignee: Xerox Corporation, Norwalk, CT (US)

( * ) Notice: Subject to any disclaimer, the term of this patent is extended or adjusted under 35 U.S.C. 154(b) by 414 days.

(21) Appl. No.: 12/434,066

(22) Filed: May 1, 2009

(65) Prior Publication Data

US 2010/0278667 A1 Nov. 4, 2010

(51) Int. Cl.
*F04B 43/12* (2006.01)

(52) U.S. Cl. ..... 417/477.6

(58) Field of Classification Search ..... 417/477.6
See application file for complete search history.

(56) References Cited

U.S. PATENT DOCUMENTS 6,491,368 B1 * 12/2002 Cipolla et al. ..... 347/23
2007/0146461 A1 6/2007 Islam et al.
2007/0148010 A1 * 6/2007 Michels et al. ..... 417/269
2009/0035165 A1 * 2/2009 Chang ..... 417/477.2
2010/0137802 A1 * 6/2010 Yodfat et al. ..... 604/152

FOREIGN PATENT DOCUMENTS

GB 2075128 A * 11/1981

* cited by examiner

*Primary Examiner* — Karabi Guharay
*Assistant Examiner* — Michael Santonocito
(74) *Attorney, Agent, or Firm* — Maginot, Moore & Beck, LLP

(57) ABSTRACT

A peristaltic pump mechanism comprises a gear having teeth configured for meshed engagement with a drive source, such as a DC motor and a pair of occlusion members configured to compress a transport tube against an occlusion surface. Each occlusion member is mounted on an axle, with one end of the axle mounted on the first gear and an opposite end of each axle engaged by a support member. Two support ribs are mounted between the gear and the support element. The pair of occlusion members includes a first pair of rollers mounted on the gear 180° apart from each other. The two support ribs are mounted on the gear 180° apart from each other and offset 90° from the pair of rollers. The DC motor drives a worm gear in meshed engagement with the gear of the pump mechanism.

12 Claims, 10 Drawing Sheets

PERISTALTIC PUMP

BACKGROUND

The present disclosure relates to peristaltic pumps. The illustrated embodiments are directed to a maintenance system for an imaging machine in which the maintenance system utilizes a peristaltic pump to transfer fluids.

In an imaging machine such as an inkjet printing system, moving surfaces are used to transfer images onto a substrate. In inkjet systems, nozzles on a printhead eject an ink image onto an intermediate transfer surface, such as a rotating transfer drum. A final receiving surface or substrate is brought into contact with the intermediate drum so that the ink image is transferred onto the substrate. A fluid release agent is then brought into contact with the intermediate transfer surface or drum to prepare the surface for the next image transfer.

Over time, the intermediate transfer surface may accumulate un-transferred pixels and debris that can diminish print quality. Left unchecked, this extraneous material can render a transfer drum unacceptable, requiring replacement of the drum. However, in some imaging or printing machines, a maintenance unit is provided that is operable to clean the transfer surface(s) of the machine. One such maintenance system is described in pending U.S. patent application Ser. No. 11/315,178, published as No. 2007/0146461, the disclosure of which is incorporated herein by reference. In general terms, one embodiment disclosed in this application includes a drum maintenance unit (DMU) 10 that is operable to clean and restore the transfer surface S of an intermediate drum D, as illustrated in FIG. 1. The DMU 10 includes an applicator assembly 12 that applies one or more fluid agents to the surface S and that simultaneously scrapes debris and pixels from the surface. In one embodiment, the applicator assembly draws a release agent from a reservoir 16 to apply the surface S with a felt roller and meters the quantity of release agent with a metering blade. The applicator assembly 12 may also include a separate blade that pre-cleans the drum surface S of debris and un-transferred pixels. The debris and excess fluid are collected and the recaptured fluid C is transferred to a collection reservoir 14. The collected fluid is drawn by a pump 20 through a filter 18 that removes larger debris. The reclaimed fluid R is returned to the reservoir 16 for reuse by the applicator assembly 12.

The DMU 10 shown in FIG. 1 is representative of devices that require self-priming pumps capable of moving solid and semi-solid particles with a fluid. In some systems, the pump 20 may be called upon to transfer fluid to multiple reservoirs within the printing machine.

Moreover, as printing machine designs become increasingly modular, the DMU also preferably evolves to a modular self-contained unit that can be periodically discarded and replaced. In this case, the DMU, and more particularly the fluid circuit within the DMU must remain sealed and leak free during shipping, storage and handling during installation. Finally, as printing machines become smaller, so too must the size of the DMU. Miniaturization of the pump within the DMU can be problematic since the smaller pump must be capable of the same duty cycle as its larger predecessor.

SUMMARY

A peristaltic pump mechanism comprises a first gear having teeth configured for meshed engagement with a drive source, such as a DC motor and a first pair of occlusion members configured to compress a first transport tube against an occlusion surface. Each occlusion member is mounted on an axle, with one end of the axle mounted on the first gear and an opposite end of each axle engaged by a support member. Two support ribs are mounted between the gear and the support element. The pair of occlusion members includes a first pair of rollers mounted on the gear 180° apart from each other. The two support ribs are mounted on the gear 180° apart from each other and offset 90° from the pair of rollers. The DC motor drives a worm gear in meshed engagement with the gear of the pump mechanism.

In one embodiment, the peristaltic pump mechanism includes a second gear having teeth configured for meshed engagement with a drive source and a second pair of occlusion members configured to compress a second transport tube against an occlusion surface. Each of the second occlusion members is mounted on a second axle having one end mounted on the second gear and an opposite end mounted on the first gear. The first pair of occlusion members include a first pair of rollers mounted on the first gear 180° apart from each other, while the second pair of occlusion members are a second pair of rollers mounted on the second gear 180° apart from each other and 90° offset from the first pair of rollers.

In a further embodiment, a peristaltic pump comprises a housing defining a pump mechanism compartment and an occlusion surface and a pump mechanism disposed for rotation within the compartment. The pump mechanism includes a pair of gears and a pair of occlusion members mounted between the gears. A transport tube is disposed within the compartment between the occlusion surface and the occlusion members of the pump mechanism. The pump further comprises a motor and an output gear rotatably driven by the motor. An idler assembly is rotatably driven by the output gear, the idler assembly including a first idler gear in meshed engagement with one of the gears, a second idler gear in meshed engagement with the other gear and a shaft connecting the idler gears.

A peristaltic pump in another embodiment comprises a housing defining a pump mechanism compartment and an occlusion surface within the compartment, a peristaltic pump mechanism disposed for rotation within the compartment and including a pair of occlusion members, a transport tube disposed within the compartment between the occlusion surface and the occlusion members, and a drive member coupled to the pump mechanism to rotate the mechanism within the compartment. The housing includes a lower housing and a cap mounted thereon the lower housing, in which the lower housing and the cap define a pair of tube retention channels to receive inlet and outlet ends of the transport tube when the tube is disposed within the pump mechanism compartment. The lower housing and the cap define alternating teeth projecting into the tube retention channel to engage the transport tube therein when the cap is mounted on the lower housing.

A kit is provided in another embodiment for assembling a single channel or a dual channel peristaltic pump comprising a pair of identically configured pump mechanisms, each including a gear having teeth configured for meshed engagement with a drive source, a pair of occlusion members configured to compress a transport tube against an occlusion surface, and a pair of support ribs mounted on the gear between the occlusion members. A support plate engages the axles of the occlusion members of one of the pump mechanisms. The kit further includes a pair of transport tubes, each configured to be disposed between an occlusion surface and the occlusion members, and a pair of lower housings each defining a pump mechanism compartment. The compartment of one of the lower housings is sized to receive one of the pump mechanisms and the support plate, while the compartment of the other of the lower housings is sized to receive the pair of pump mechanisms and the support plate stacked on top of each other. A cap is provided that is engageable to either of the pair of lower housings to enclose the pump mechanism compartment. The kit further includes a drive member coupled to the gear of at least one of the pair of pump mechanisms disposed within the pump mechanism compartment for rotating the pump mechanism.

DESCRIPTION OF THE ILLUSTRATED EMBODIMENTS

Figure 1:
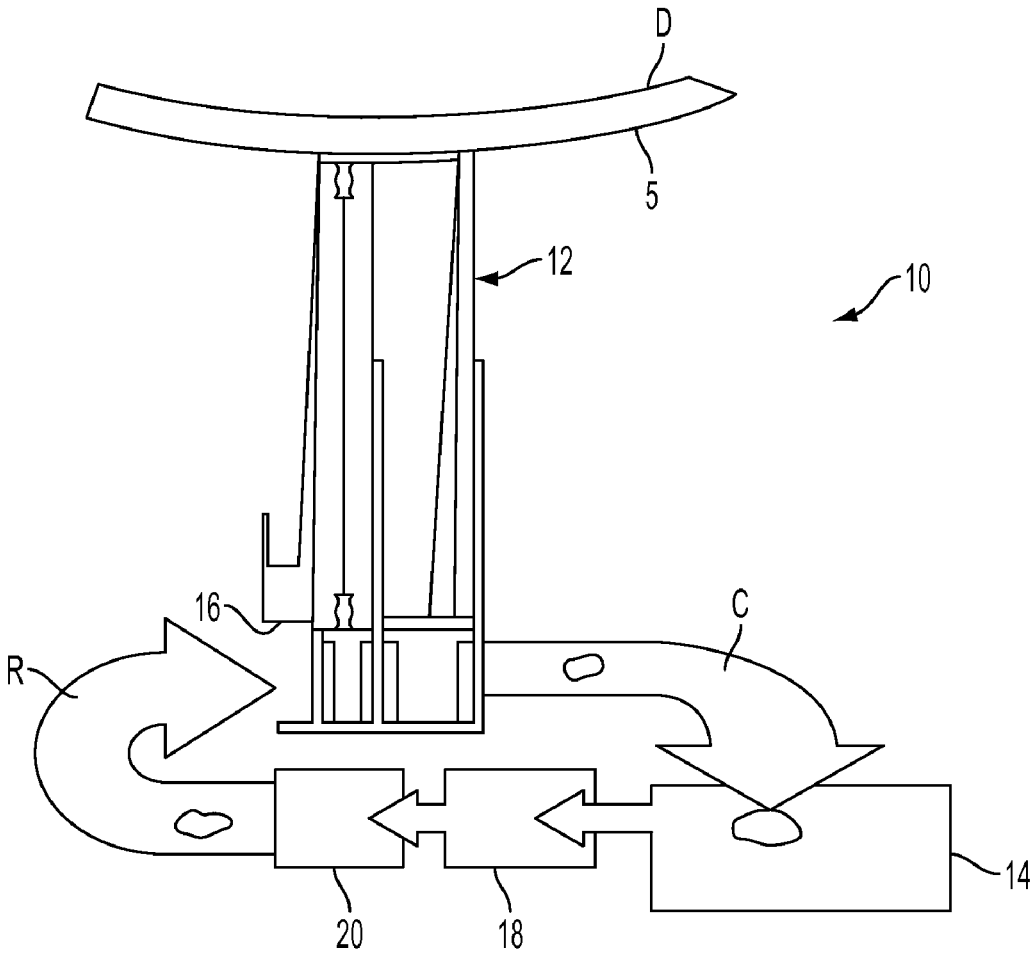
FIG. 1 PRIOR ART
FIG. 1 is a representation of a drum maintenance unit with fluid reclamation features.
Figure 2:
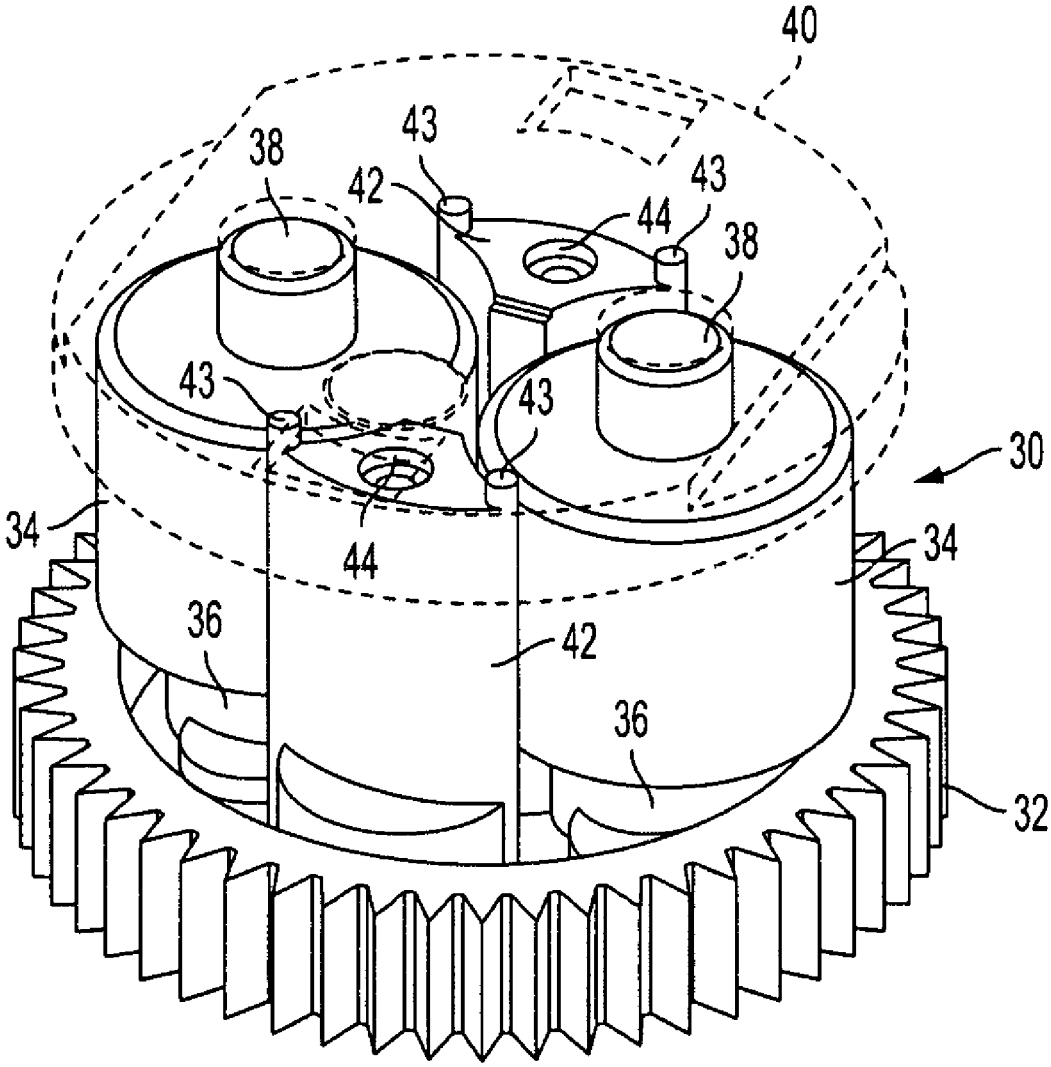
FIG. 2 is a perspective view of a single channel peristaltic pump mechanism according to one embodiment disclosed herein.

A peristaltic pump mechanism 30 is provided in a compact modular package, as shown in FIG. 2, and combines high flow-to-volume and flow-to-cost ratios with the ability to pump fluids with solid contaminants. As described herein, this pump mechanism can be utilized for the pump 20 in the drum maintenance unit 10 depicted in FIG. 1. However, it is understood that the embodiments described herein may be used in other machines and devices to deliver a variety of fluids.

Figure 4:
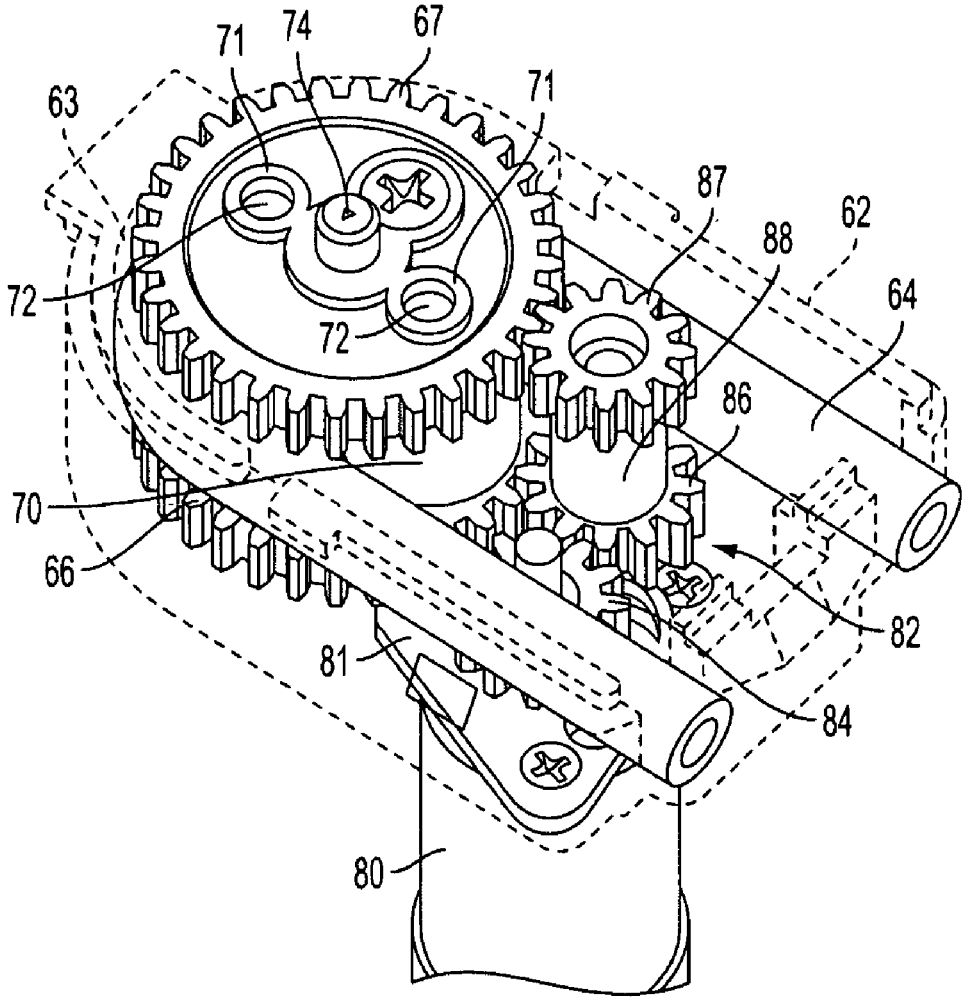
FIG. 4 is a top perspective view of a single channel peristaltic pump mechanism according to another embodiment disclosed herein, shown with the mechanism mounted within a lower housing.

The pump mechanism shown in FIG. 2 is a single channel embodiment, meaning that a single tube, such as tube 64 shown in FIG. 4, passes through the mechanism for transporting a single fluid therethrough. The pump mechanism includes a gear 32 that is rotated by a drive source. The conventional peristaltic pump is typically provided with three or more rollers spaced at even angular intervals to ensure occlusion and sealing of the transport tube. The multiple rollers are supported on a carriage articulated through a central post. In order to reduce the space requirement from the package size required for the conventional pump, the peristaltic pump mechanism 30 disclosed herein relies upon a pair of occlusion members 34, offset by 180°, that are configured to compress the transport tube in a known manner. The rollers are carried by an axle 38 which is supported on a roller mount 36 that is integral with the gear. The roller mounts may be configured with a bearing recess, such as the recesses 71, which receive the roller axles 72 shown in FIG. 4. The occlusion members 34 are preferably rollers rotatably mounted on the axle 38 or rotatable with the axle 38 relative to the gear 32.

In conventional peristaltic pumps, the three or more rollers are mounted within a carriage and the carriage is driven by way of a central shaft. The central shaft is driven by the power source. In order to decrease the overall size of the pump mechanism 30, the gear 32 is driven while also functioning as the carriage for supporting the peristaltic rollers 34. The power transmission to the pump mechanism is direct. This configuration also eliminates the structure found in conventional pumps for supporting the central shaft.

In order to avoid any occlusion problems, the rollers operate within an occlusion surface that extends through more than 180° of the gear rotation. Thus, as depicted in FIG. 4, the occlusion surface 63 of the lower housing 62 supports the tube 64 past the 180° point of the gear rotation. The occlusion surface 63 merges tangentially into the side wall surfaces 68 that hold the tube 64 in a U-shaped configuration to ensure that the rollers maintain contact with the tube beyond the 180° rotation point.

In the conventional peristaltic pump designs, the use of three or more rollers provides structural stability and strength to the carriage and pump. In the pump 30 this strength and stability is supplied by a pair of support ribs 42 that are attached at one end to the gear 32, as seen in FIG. 2. The support ribs 42 are diametrically opposite each other and are offset 90° from the rollers 34. The ribs can be contoured as shown in FIG. 2 to fit tightly in the space between the rollers, thereby reducing the overall dimensions of the pump mechanism 30 relative to conventional peristaltic pump designs. Thus, the outer surface 42*a* may extend generally parallel to and immediately adjacent, but inside, a tangent line between the two rollers 34. The inner surface 42*b* may be triangular or frustum-shaped and contoured to substantially follow the curvature of the cylindrical rollers in the space between the rollers.

Figure 3:
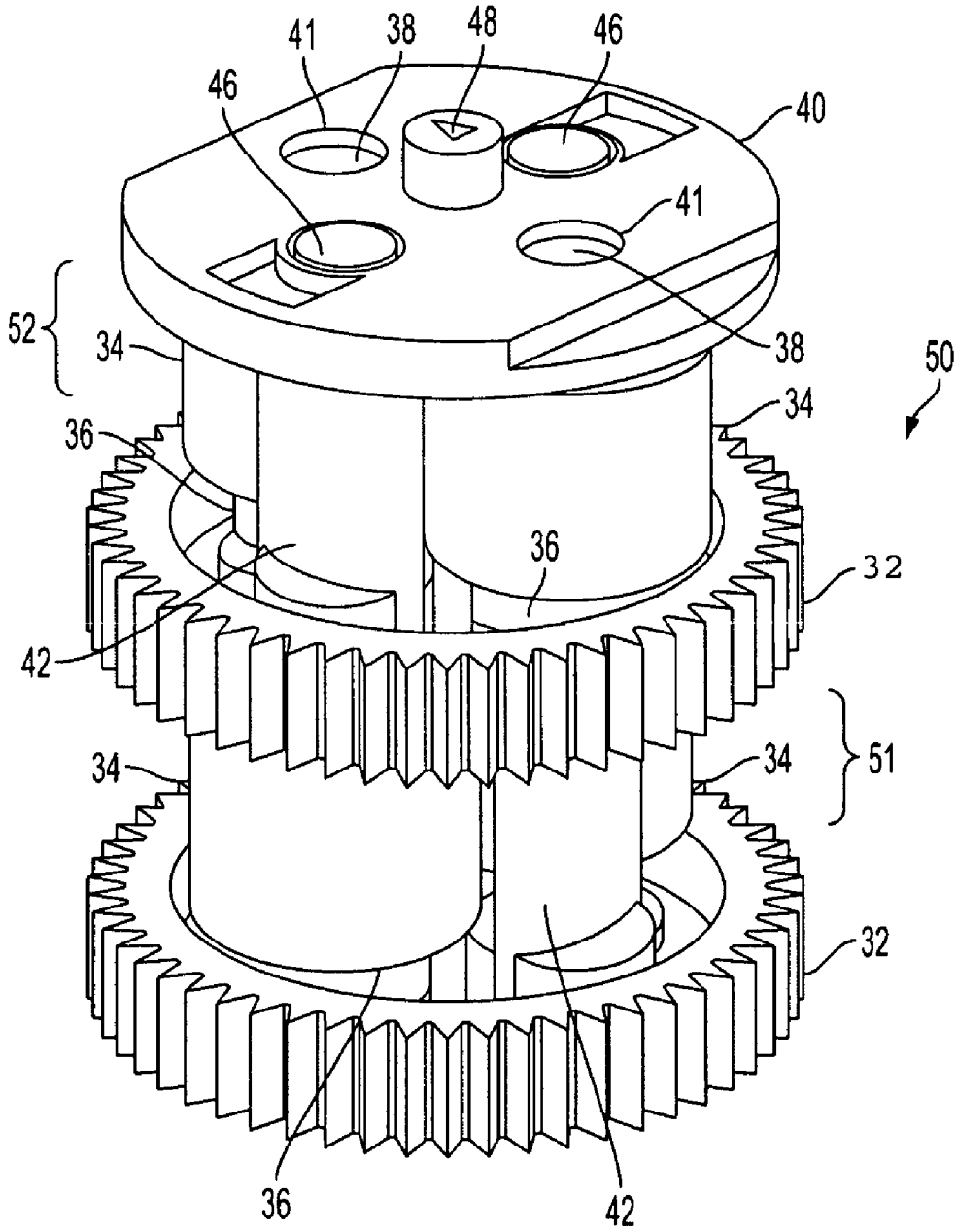
FIG. 3 is a perspective view of a dual channel peristaltic pump mechanism according to a further embodiment disclosed herein.

The pump mechanism further includes a support plate 40 that is mounted on the support ribs. The support plate defines axle bores 41 (FIG. 3) to receive the roller axles 38. The support ribs 42 are attached to the support plate 40 with alignment posts 43 that are received within mating bores (not shown) in the plate. An attachment pin 46 may extend through the plate 40 into a mating recess 44 in the support rib, as shown in FIGS. 2-3. A similar mating arrangement can be incorporated into the attachment of the ribs to the gear. In lieu of the pin, an engagement screw 75, as shown in FIG. 4, may be used to fix the support rib to the support plate 40 and/or the gear. Alternatively, the ribs 42 may be integrally formed with either the gear 36 or the support plate 40. When the pump mechanism is assembled—i.e., when the rollers 34 have been mounted on the gear—the mating arrangements may be permanently affixed, such as by sonic welding or by an adhesive, or may be semi-permanently affixed, such as by press-fit or interference-fit engagement.

In the embodiment illustrated in FIG. 2, the pump mechanism is configured as a single channel pump. Thus, one pair of rollers is provided to engage a single tube. In the embodiment shown in FIG. 3, the pump mechanism 50 is configured as a dual channel pump. In this embodiment, two sets of rollers 34 are provided to engage a pair of tubes. The components of the pump mechanism 30 shown in FIG. 2 are designed for modularity to permit assembly of a single or a multiple channel pump by adding like components to the assembly. It can be seen in FIG. 3 that the lower channel 51 of the pump mechanism 50 includes the same components as the upper channel 52, namely the gear 32, rollers 34 and support ribs 42. The upper channel 52 is capped with the support plate 40 in the same manner as in the single channel pump mechanism 30.

As part of this modularity, the underside of the gear 32 is configured to mate with the roller axles 38 and the interface elements 34 and 46 of the support ribs. Thus, the underside of each gear 32 and the underside of the support plate 40 are similarly configured. It is further contemplated that gear can be identically configured on both faces to enhance the modularity of the components.

As seen in FIG. 3, the rollers 34 of the lower channel 51 are offset 90° from the rollers of the upper channel 52. It is known that the torque load in a peristaltic pump can fluctuate as the rollers engage and disengage the transport tube. In order to minimize the peak torque demand for the motor driving the dual channel pump, the carriage supporting the rollers (i.e., the gears, support ribs and support plate) are configured so that the rollers 34 of the lower channel 51 are offset 90° from the rollers of the upper channel 52, as seen in FIG. 3. In other words, the rollers in the lower channel 51 are 90° out of phase relative to the rollers of the upper channel 52. This arrangement of rollers results in a peak torque load that is about half of the load for rollers that are in phase. Although the power requirements for driving a dual channel pump is unchanged by the roller orientation, the reduction in peak torque leads to a reduction in peak current demand for the motor. Lower peak current allows the use of a smaller motor. It can also be noted that the out of phase positioning of the rollers minimizes the amplitude of the torque fluctuations which in turn decreases the cyclic load experienced by the pump mechanism. Decreasing the cyclic load improves the fatigue life of the pump 50.

As shown in FIG. 3, the support plate 40 includes a mounting hub 48. This mounting hub is configured to mate with a corresponding recess defined in the housing containing the pump mechanisms 30, 50. In one embodiment, the recess is defined in the caps 103, 103' shown in FIGS. 8-9. The gears may include a similar mounting hub, such as the hub 74 on the gear 67 shown in FIG. 4, for engagement with a corresponding recess in the lower housing, such as lower housings 102, 102' in FIGS. 8-9. It is contemplated that a hub 74 may be incorporated into both sides of the gear 32 (FIG. 2) and 66, 67 (FIG. 4) to mate with corresponding recesses in the upper and lower portions of the housing. The mounting hub 48 is configured to provide a bearing surface for rotation of the pump mechanism within the housing.

The dual channel pump mechanism 50 is well-suited for certain DMU systems where the subject fluid is transported to two different locations. In some DMUs the fluid agent is delivered to two locations along the length of an applicator. In prior systems this two location delivery is accomplished by a T-fitting on the output of a single channel pump. The addition of a fluid fitting increases the risk of leakage. Moreover, the fluid flow through each branch of the T-fitting was not uniform, either due to downstream pressure differences or concentration of debris in one branch. The dual channel capability of the pump mechanism 50 provides two distinct isolated outputs so that substantially the same fluid flow is seen at both locations of the DMU applicator.

The modularity of the pump components permits a pump construction as shown in FIG. 4 in which a single channel pump 60 is provided with a single pair of rollers 70 but includes two gears 66, 67. The dual gears of the dual channel pump 50 of FIG. 3 and the single channel pump 70 of FIG. 4 permits a novel drive mechanism for rotating the gears. As shown in FIG. 4, a motor 80 is carried by a motor mount 81 that is attached to, or alternatively integral with, the lower housing 62 that contains the pump mechanism. A transmission 82 connects the output shaft (not shown) of the motor to the two gears 66, 67. In one embodiment, the transmission 82 includes a pinion gear 84 fastened to the motor output shaft. The pinion gear meshes with a lower idler gear 86 that is connected to an upper idler gear 87 by a shaft 88. The lower idler gear 86 is in meshed engagement with the lower gear 66 while the upper idler gear 87 meshes with the upper gear 67. The two idler gears thus drive both gears, thereby eliminating the torsional bending that can occur when just the lower gear is driven. Since both gears 66, 67 are driven at the same rotational speed, via the idler gears 86/87, the rollers 70 will maintain a steady uniform pressure on the transport tube 64 during peristaltic operation. In an alternative configuration, the pinion gear can mesh with a separate gear in the middle of the shaft 88 to equalize possible torsional deflections between the two idler gears 86/87.

Figure 5:
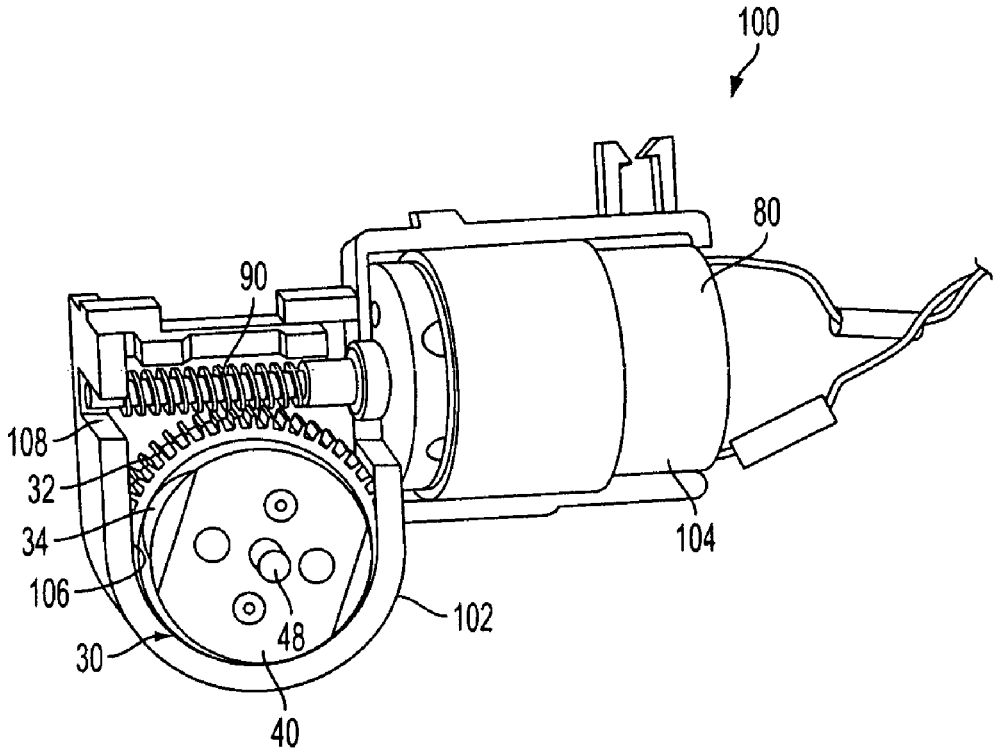
FIG. 5 is a top perspective view of a single channel peristaltic pump according to another embodiment disclosed herein.
Figure 6:
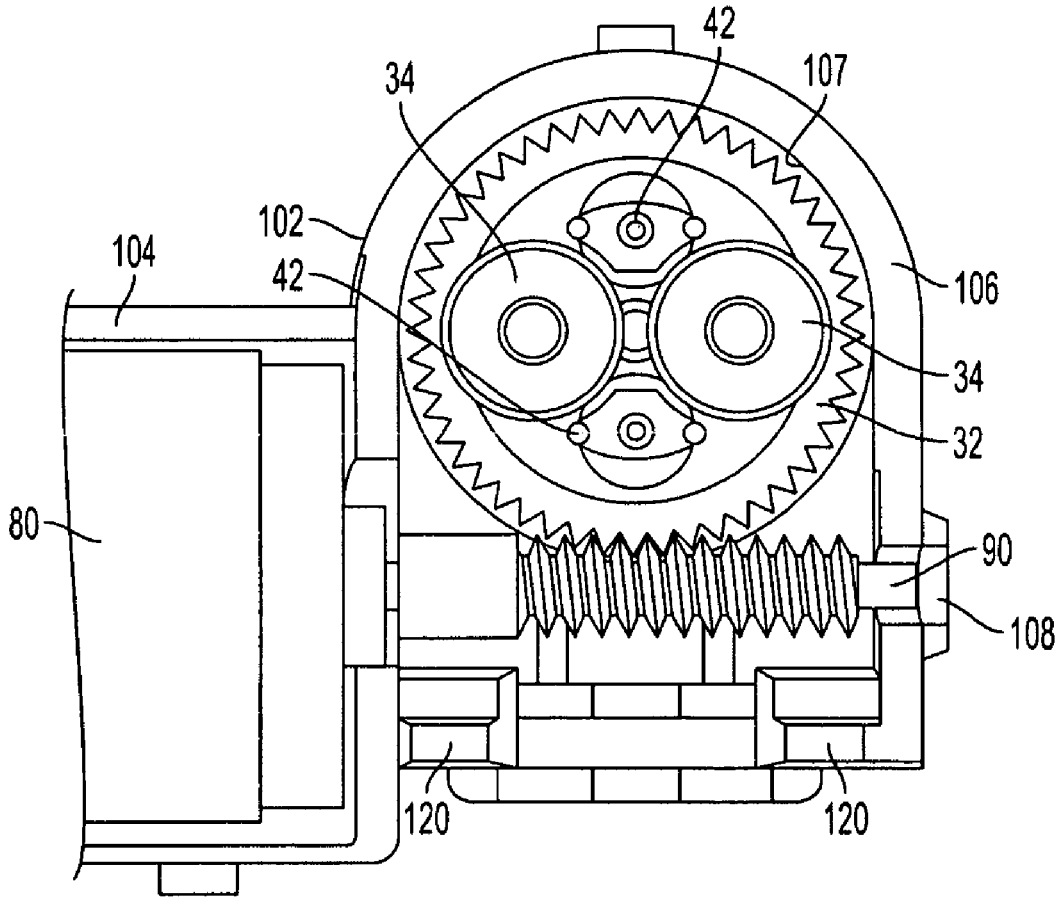
FIG. 6 is a top elevational view of the pump shown in FIG. 5.
Figure 7:
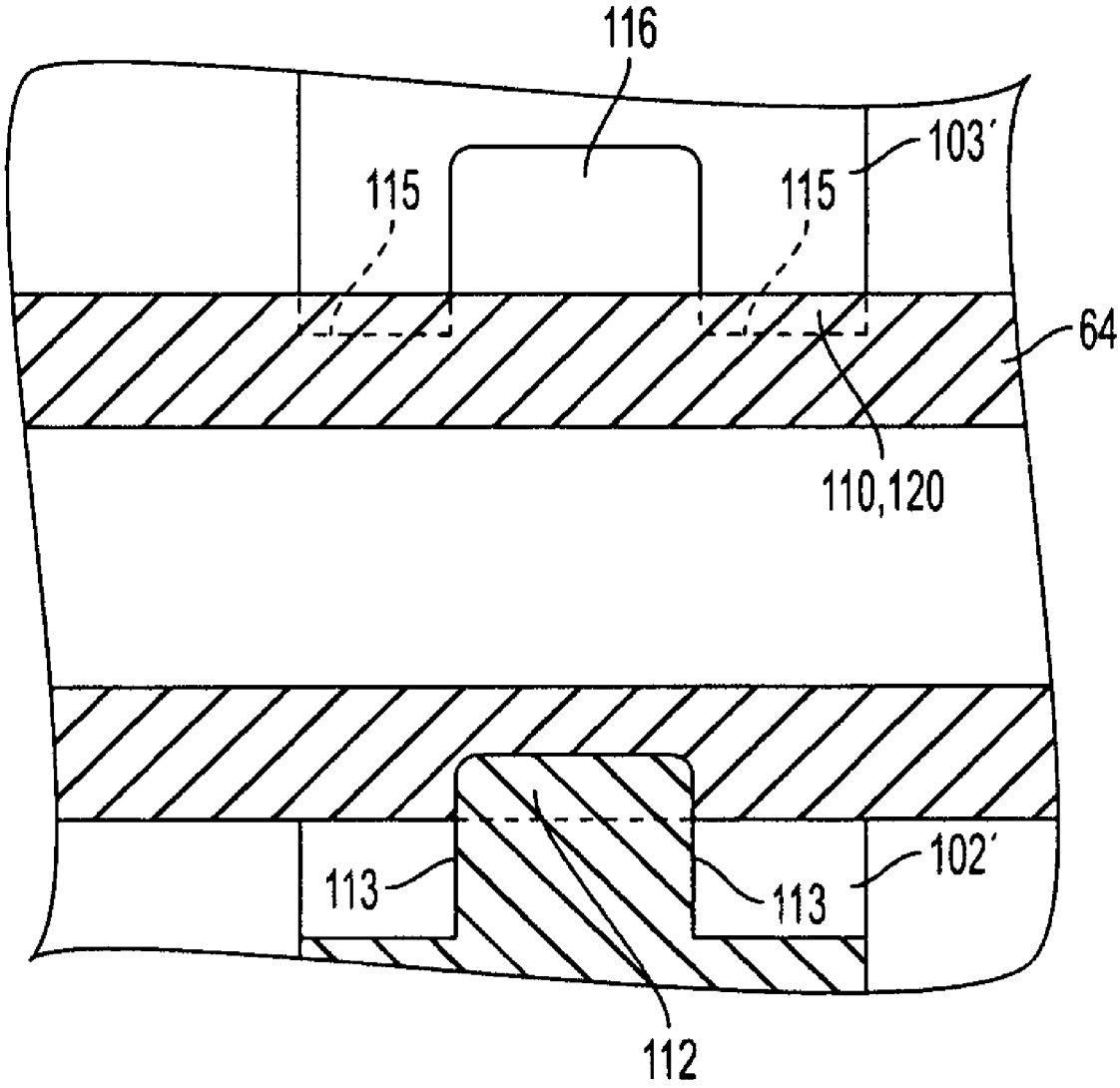
FIG. 7 is an enlarged cross-sectional view of a tube retention feature of the pump shown in FIGS. 5-6.

A further benefit provided by the disclosed peristaltic pumps is that the pump mechanism is compact and assumes a much smaller envelop than known pumps. Integrating the rotational drive directly into the carriage supporting the rollers 34, 70 helps in this miniaturization of the pump. The gears 66, 67 and transmission 82 of the embodiment in FIG. 4 provide a compact drive mechanism for the peristaltic rollers. A further reduction in pump size can be accomplished as shown in FIGS. 5-6. In this embodiment, a pump 100 includes the motor 80 mounted within the motor compartment 104 of a lower housing 102. A pump mechanism compartment 106 contains the pump mechanism, which is shown in FIG. 4 as the single channel mechanism 30 of FIG. 2. The gear 32 of the pump mechanism is driven by a lead screw or worm gear 90 extending from or forming part of the motor drive shaft. The lower housing defines a bearing slot 108 that supports the free end of the worm gear 90. The slot may include a bearing or bushing, or may be formed of a bearing-type material, such as a Delrin® plastic or similar material. It can be noted from FIGS. 5 and 8 that the bearing slot 108 is open in the lower housing 102 to facilitate assembly of the pump 100.

The motor may be a small DC brush motor connected to an external power supply and control system. Depending upon the application, the motor control system may use pulse width modulation to control the rotational speed to thereby control the flow rate and avoid over-heating. In one specific application for use as the motor 20 in the DMU 10 shown in FIG. 1, the motor is operable to deliver an average total flow rate of 2.20 mL/min/channel. In this specific embodiment, the gear ratio between the worm gear 90 and the gear 32 is 48:1.

It has been discovered that the miniaturization of the pump mechanism as disclosed herein can actually increase the flow rate capacity of a given motor. In the disclosed embodiments, the carriage supporting the rollers—or more specifically the gear 32, support ribs 42 and support plate 40—can have a smaller diameter than conventional peristaltic pumps. This reduced diameter reduces the moment arm of the torque load on the carriage. Reduction of the torque load allows the DC motor to run at a higher speed, which may even result in an increase in flow rate depending on the stall torque of the motor.

In the embodiment shown in FIGS. 5-10 the driving gear is a worm gear that is oriented generally perpendicular to the pump compartment 106 of the lower housing 102. It should be understood that other angular orientations of the worm gear relative to the pump compartment may be contemplated, including a configuration in which the worm gear 90 extends generally parallel to the longitudinal axis of the compartment. In this configuration the motor compartment 104 would be generally aligned with the pump compartment, instead of at the right angle orientation shown in FIG. 6. The packaging of the motor, worm gear and pump mechanism can be determined by the size and shape of the space within which the pump is to reside.

In the illustrated embodiment, the power transmission from motor 80 to gear 32 is through the worm gear 90. This approach provides the benefit of substantial tooth engagement between the gears, as seen in FIG. 6. In alternative embodiments, the transmission interface between the motor and pump mechanism may incorporate other gear configurations such as a spur, helical or bevel gear arrangement.

Figure 8:
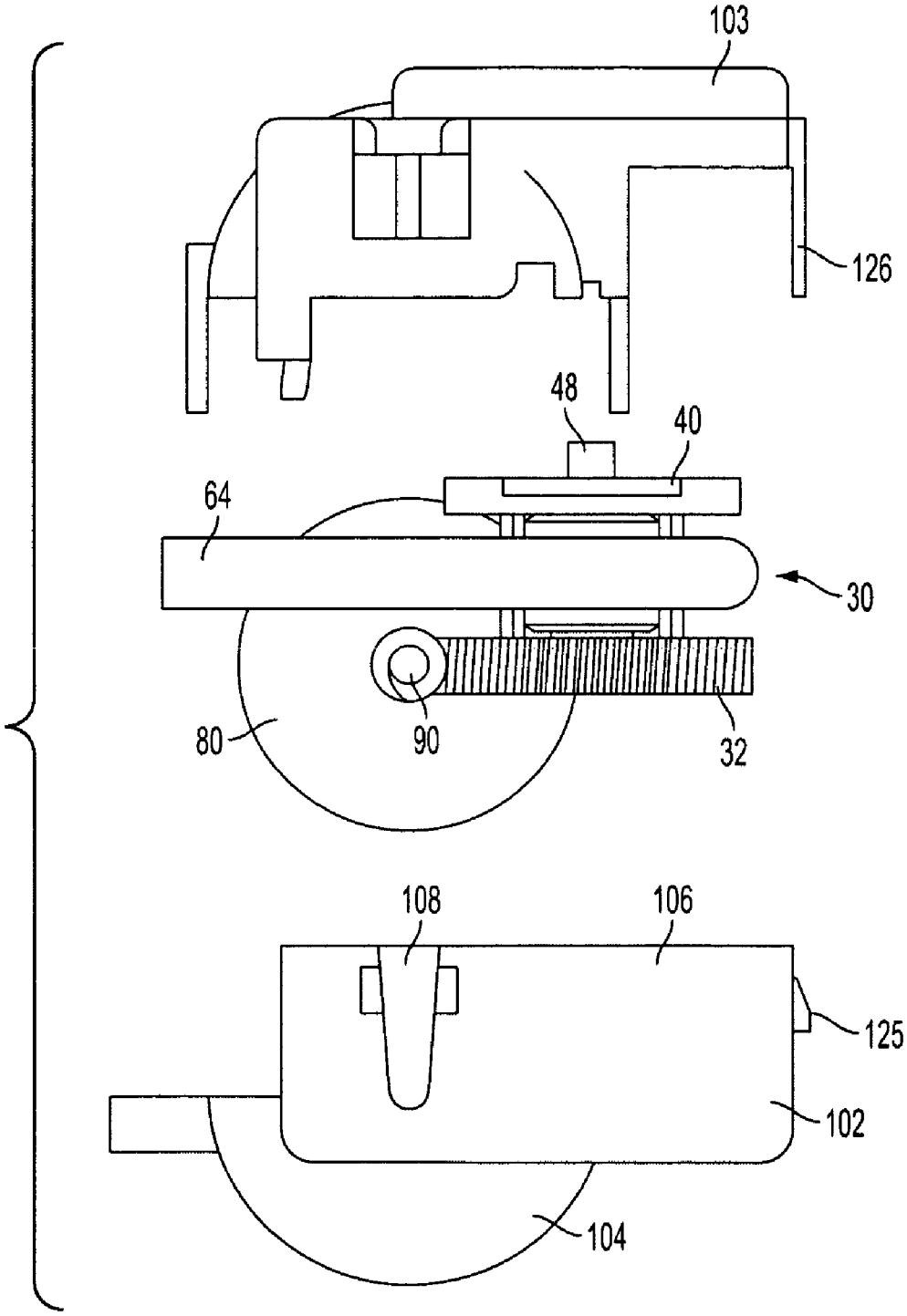
FIG. 8 is an exploded view of components of a single channel peristaltic pump according to one disclosed embodiment.

In one manner of assembly, illustrated in FIG. 8, the motor is dropped into the motor compartment 104 with the worm gear 90 residing in the slot. The pump mechanism 30, including the tube 64 wrapped around the rollers 34, may then be dropped into the compartment 106 of the lower housing 102 with the gear 32 meshed with the worm gear 90 and the U-shaped tube disposed over the worm gear. The lid 103 engages the lower housing 102 to complete the assembly. As explained above, the interior of the lower housing and lid define recesses to rotationally support the mounting hub 48 of the support plate 40, and optionally the hub 74 of the gear. The housing and lid may be configured for snap or interlocking engagement, such as the notch 125 and latch 126 shown in FIG. 8.

Figure 9:
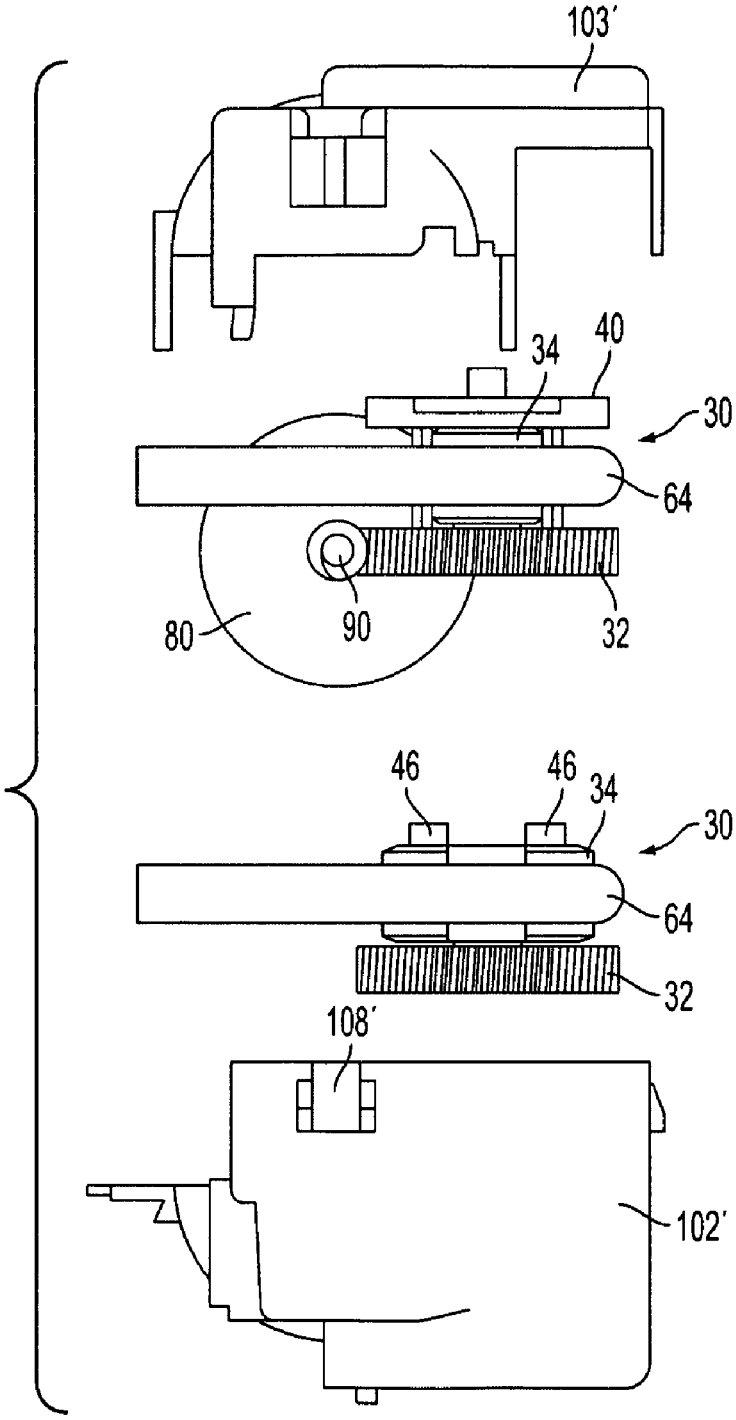
FIG. 9 is an exploded view of components of a dual channel peristaltic pump according to another disclosed embodiment.
Figure 10:
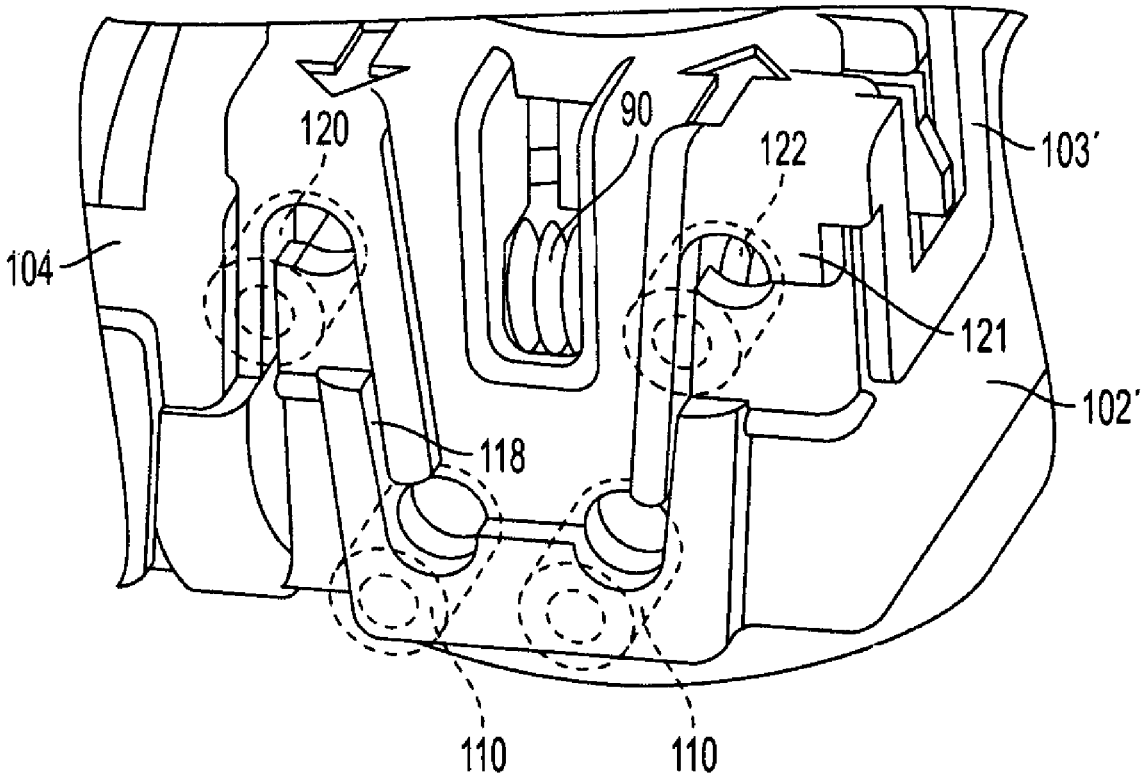
FIG. 10 is an enlarged view of a portion of the assembled dual channel peristaltic pump shown in FIG. 9.

Assembly of a dual channel pump is depicted in FIG. 9. In this embodiment, the lower housing 102' is deeper than the lower housing 102 of the single channel pump in FIG. 8 to accommodate the two pump mechanisms 30. In addition, the bearing slot 108' is shallower than the slot 108 in the single channel embodiment. In the dual channel embodiment, the lowermost pump mechanism is disposed beneath the worm gear 90, while the uppermost mechanism 30 is disposed above the worm gear, as shown in FIG. 9. The positioning of the transport tubes is illustrated in FIG. 10. In particular, the lower tube passes through lower tube retention channels 110 while the upper tube passes through the upper retention channels 120. It can be appreciated from FIG. 10 that the retention channels are defined at the interface between the lower housing 102' and the lid 103'. Consequently, the lower retention channels 110 are offset inward from the upper channels 120. The lower housing 102' defines a central window 118 that receives a central flange 119 of the lid 103'. The lower retention channels are thus defined at the interface between the window 118 and the flange 119. The upper channels 120 are defined at the interface between the upper edge 121 of the lower housing 102' and the body 122 of the lid 103'.

In prior peristaltic pump designs, fitting are required to engage the transport tube(s) to hold them in position within the housing while the rollers apply pressure to the tube(s). While these fittings are adept at holding the tube position they inherently increase the risk of leakage. In addition, the fitting-to-tube interface becomes a collection point for debris entrained within the fluid flow. Consequently, while conventional peristaltic pumps are well-suited to moving "dirty" fluids, they are susceptible to becoming clogged, particularly on the suction side of the transport tube. The clogs also increase the risk of fluid leak at the fitting. Consequently, in the pump assemblies disclosed herein, no fittings are required due to the configuration of the tube retention channels 110, 120. In the exemplary configuration shown in FIG. 7 the lower housing 102' defines a retention tooth 112 flanked by a pair of recesses 113. The lid 103' defines a recess 116 flanked by a pair of teeth 115. The recesses and teeth are alternating or complementary meaning that the tooth 112 directly opposes the recess 116, and the recesses 113 directly oppose the upper teeth 115. The teeth 112 and 115 are configured to project slightly into the corresponding retention channel 110, 120. The teeth thus compress and slightly bend the tube 64 at the retention channel so that the tube bows slightly upward into the upper recess 116 and downward slightly into the lower recesses 113. This configuration prevents the tube from crawling out of the pump housing under the rotating pressure of the rollers.

It is contemplated that the components of the peristaltic pumps and pump mechanisms disclosed herein are formed of materials suitable for fluid transport. For instance, the components forming the carriages in the different embodiments, namely the gears, support ribs and support plates, can be formed of a suitable plastic. The rollers may be of conventional design and formed of a hard plastic or rubber material.

It will be appreciated that various of the above disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A peristaltic pump mechanism comprising:

a first gear having teeth configured for meshed engagement with a drive source;

a support element positioned parallel to the first gear;

only one pair of occlusion members positioned between the support element and the first gear, each occlusion member being a cylindrical roller and the one pair of cylindrical rollers being configured to compress a first transport tube against an occlusion surface, each cylindrical roller in the one pair of cylindrical rollers being mounted about one axle in a first pair of axles in a one-to-one correspondence, one end of each axle in the first pair of axles being mounted on said first gear to position the two cylindrical rollers in the one pair of cylindrical rollers 180° apart from each other; and only one pair of support ribs mounted between said first gear and said support element, the support ribs being positioned 180° apart from each other and 90° apart from each cylindrical roller in the one pair of cylindrical rollers, each support rib having a generally triangular or frustum-shaped inner surface facing and immediately adjacent said one pair of cylindrical rollers, the inner surface of each support rib being curved to substantially match a curvature of said cylindrical rollers.

2. The peristaltic pump mechanism of claim 1, wherein each support rib of said one pair of support ribs includes an outer surface facing away from said one pair of rollers, said outer surface of each support rib being disposed adjacent a tangent line between said rollers.

3. The peristaltic pump mechanism of claim 1, wherein said support element is a second gear having teeth configured for meshed engagement with a drive source.

4. The peristaltic pump of claim 3 further comprising:

a housing defining a pump mechanism compartment and the occlusion surface, the first gear, the only one pair of cylindrical rollers, and the support ribs being disposed for rotation within said pump mechanism compartment and the first transport tube being disposed within said pump mechanism compartment between said occlusion surface and said cylindrical rollers;

a motor;

an output gear rotatably driven by said motor;

an idler assembly rotatably driven by said output gear, said idler assembly including;

a first idler gear in meshed engagement with said first gear;

a second idler gear in meshed engagement with said second gear; and a shaft connecting said first and second idler gears.

5. The peristaltic pump mechanism of claim 1, wherein said support element is a plate.

6. The peristaltic pump mechanism of claim 1, wherein said peristaltic pump mechanism includes:

a second gear having teeth configured for meshed engagement with a drive source;

a second pair of occlusion members configured to compress a second transport tube against an occlusion surface, each occlusion member in the second pair of occlusion members being mounted on one axle in a second pair of axels in a one-to-one correspondence, one end of each axle in the second pair of axles being mounted on said second gear and an opposite end of each axle in the second pair of axles being mounted on said first gear to position the two occlusion members in the second pair of occlusion members 180° apart from each other.

7. The peristaltic pump mechanism of claim 6, wherein:

said one pair of occlusion members between the support element and the first gear are a pair of rollers; and said second pair of occlusion members is a second pair of rollers mounted about said second pair of axles to position the rollers in the second pair of rollers 90° offset from said pair of rollers between the support element and the first gear.

8. The peristaltic pump mechanism of claim 6, wherein said first and second gears are identical.

9. The peristaltic pump mechanism of claim 6 further comprising:

a second pair of support ribs mounted between said first gear and said second gear.

10. A peristaltic pump comprising:

a housing defining a pump mechanism compartment and an occlusion surface within said pump mechanism compartment;

a motor;

a worm gear rotated by said motor;

a peristaltic pump mechanism disposed for rotation within said pump mechanism compartment and including;

a first gear having teeth configured for meshed engagement with said worm gear;

only one pair of cylindrical rollers configured to compress a first transport tube against said occlusion surface, each cylindrical roller in the one pair of cylindrical rollers being mounted about one axle in a first pair of axles in a one-to-one correspondence, one end of each axle in the first pair of axles being mounted on said first gear; and a support element engaging an opposite end of each axle in the first pair of axles, the axles in the first pair of axles positioning the cylindrical rollers in the one pair of cylindrical rollers between the support element and the first gear 180° apart from each other;

only one pair of support ribs mounted between said first gear and said support element, the support ribs being positioned 180° apart from each other and 90° apart from each cylindrical roller in the one pair of cylindrical rollers, each support rib having a generally triangular or frustum-shaped inner surface facing and immediately adjacent said one pair of cylindrical rollers, the inner surface of each support rib being curved to substantially match a curvature of said cylindrical rollers; and a transport tube disposed within said pump mechanism compartment between said occlusion surface and said cylindrical rollers of the one pair of cylindrical rollers.

11. The peristaltic pump of claim 10, wherein:

said support element is a support plate having a mounting hub; and said housing defines a mating recess for receiving said mounting hub to permit rotation of said pump mechanism relative to said housing.

12. The peristaltic pump of claim 10, wherein said housing defines a motor compartment intersecting said pump mechanism compartment with said motor disposed therein.

* * * * *